United States Patent [19]

Jacob

[11] Patent Number: 4,908,604

[45] Date of Patent: Mar. 13, 1990

[54] REMOTELY CONTROLLED SECURITY SYSTEM

[75] Inventor: Keith D. Jacob, Ann Arbor, Mich.

[73] Assignee: Dimango Products Corporation, Brighton, Mich.

[21] Appl. No.: 98,802

[22] Filed: Sep. 21, 1987

[51] Int. Cl.[4] ..... G08B 1/08; G08B 23/00

[52] U.S. Cl. ..... 340/539; 340/527; 340/528; 340/531; 340/430; 307/10.4

[58] Field of Search ..... 340/539, 500, 506, 528, 340/527, 531, 63–65, 825.69, 825.72, 430; 307/10 A T, 9.1, 10.1, 10.2, 10.4, 10.5

[56] References Cited

U.S. PATENT DOCUMENTS

| | | | |
|---|---|---|---|
| 3,833,895 | 9/1974 | Fecteay | 340/539 |
| 3,925,763 | 12/1975 | Wadhwani et al. | 340/539 |
| 3,978,478 | 8/1976 | Schmitz | 340/506 |
| 4,092,643 | 5/1978 | Stolarczyk | 340/528 |
| 4,257,038 | 3/1981 | Rounds et al. | 340/539 |
| 4,383,242 | 5/1983 | Sassover et al. | 340/539 |

*Primary Examiner*—Donnie L. Crosland

*Attorney, Agent, or Firm*—Reising, Ethington, Barnard, Perry & Milton

[57] ABSTRACT

A security system which includes remotely controlled entrance monitors (12) to indicate when an intrusion has occurred, an arming/disarming control (18), a console (14) responsive to the entrance monitors and arming/-disarming control, and an alarm (16) responsive to the console for audibly indicating intrusion. These components are completely wireless with one another. Radio coded signals are transmitted between components requiring a coded combination between the console and entrance monitors, and a coded combination between the console (14) and alarm (16) and arming/disarming control (18). The arming/disarming control (18) includes an arming button (20) for arming the system and a disarming button (22) for disarming the system with a slideable protective cover thereover to prevent accidental depression of either button.

28 Claims, 4 Drawing Sheets

REMOTELY CONTROLLED SECURITY SYSTEM

TECHNICAL FIELD

The invention relates to a security system which activates an alarm in response to an intrusion, and more specifically, to a completely remotely controlled security alarm system.

BACKGROUND OF THE INVENTION

Many security systems use the following: door and window units for sensing an intrusion by the opening thereof, a main console to which the door and window units are wired in connection therewith, and either key or number pad arming and disarming units on the inside of the door or window. The cost and difficulty involved in installation of such a system is expensive and complex. Therefore, security systems have used remote door and window units which transmit radio signals upon the opening thereof. A remote console receives radio signals and will turn an alarm on if the console is in the armed state.

One such security system is disclosed in U.S. Pat. No. 3,833,895 granted Sept. 3, 1974 in the name of Dennis E. Fecteau. This patent discloses magnetic normally-closed door or window unit which transmits a coded radio signal if a switch in the unit is opened. The master unit or console includes an arming or power switch to set the device in the armed or alarm mode. When in the armed mode, if the master unit receives a coded signal from a door or window unit, an alarm will be sounded. The door unit includes a button which is to be depressed when a person exits a door, causing a delay in the triggering of the console. This patent also discloses a hand held unit which includes two buttons. A first button may be depressed to indicate that a prior intrusion has occurred by not sounding a beep. When this button is depressed, the console is disabled until resetting it by turning the power off and on. The second button is a panic button which immediately turns the alarm on when depressed. A problem with this type of device is a delay in the system when a person is exiting the house. Additionally, when the intrusion button is depressed, the system is disabled until manual reset on the console. Another problem with this type of system is that the system can not be armed remotely. Also, an intruder may easily find the console by the alarm sound and cut the wires from the console to the alarm.

Another type of security system is related to the remote control of a garage door and the securing of a house. Such a system is disclosed in U.S. Pat No. 4,464,651 issued Aug. 7, 1984 in the name of Dean C. Duhame. This patent discloses a radio transmitter unit which will close the garage door and arm the system by locking the door. The transmitted signals between the transmitter and the central control unit coded and selected by the consumer through switches. The transmitter unit includes a secure button which is a toggle between arming and disarming. Portal switches from doors and windows may be interconnected directly to the security alarm. A problem with this type of system is that the user may forget the state of the security system, and the system is integrally related to garage door systems. Accidental depression of the buttons may occur disabling or enabling the system without the consumers knowledge. Additionally, the same problem arises with the integral console and alarm as in the previous prior art.

SUMMARY OF INVENTION AND ADVANTAGES

The invention is a security assembly and a method for indicating when a closable entrance has been opened. The assembly includes entrance monitoring means for producing an intrusion coded signal when the entrance has been opened, and a console means for receiving the intrusion coded signal producing an alarm radio signal indicating the intrusion. The system is characterized by alarm means remote from the console means for receiving the alarm radio signal to produce an audible signal.

The invention also includes a console means having an armed mode and disarmed mode for receiving the intrusion signal and indicating when the entrance has been opened when the console means is in the armed mode. A remote control means sets the console means in the armed or disarmed mode. The remote control means includes arm button means to be manually depressed to set the console means in the armed mode by transmitting an arming coded radio signal and disarm button means to be manually depressed to set the console means in the disarmed mode by transmitting a disarming coded radio signal. Also included is a protective cover means for sliding across one of said buttons exposing the other for depression and sliding partially over both of said buttons to prevent accidental depression of said buttons.

Advantages of this invention are that the console and the alarm means are not wired together which will prevent deactivation thereof by an intruder, and the installment procedures are easier. Also, by including separate arm and disarm buttons, a user may always be sure which state the security device has left in by double checking by depressing the disarm button. Additionally, the protective cover on the remote control means will insure against accidental activation or deactivation of the alarm system.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
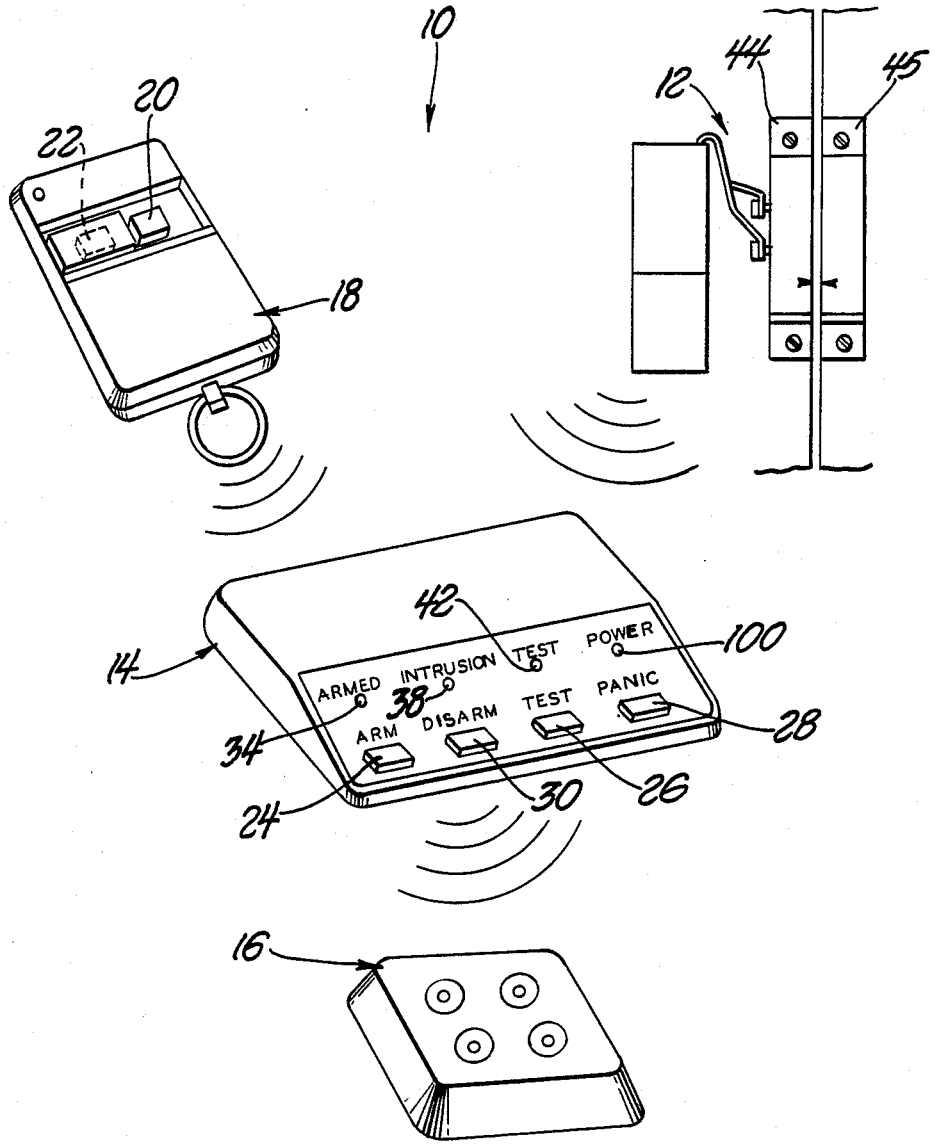
FIG. 1 is a perspective view of the remote components of the subject invention.

A security assembly for indicating when a closable entrance has been opened is generally shown at 10 in FIG. 1. The assembly 10 includes entrance monitoring means 12 for producing an intrusion coded signal when the entrance has been opened or intruded, console means 14 for receiving the intrusion signal and producing an alarm radio signal indicating intrusion, alarm means 16 remote from the console means 14 for receiving the alarm radio signal to produce an alarm or indication signal, and remote control means 18 for setting the console means 14 in an armed and disarmed mode. The entrance monitoring means 12, the console means 14, the alarm means 16, and the remote control means 18 are all remotely controllable with respect to one another by transmitting and receiving radio signals producing a completely wireless security alarm assembly 10. Therefore, installation of the subject invention may be accomplished by the consumer without disturbing or re-constructing the premises to be secured.

In general, the console means 14 is the main controller of the assembly 10 which receives and/or transmits coded radio signals to each of the other means. The alarm means 16 produces an audible piercing sound in response to receiving coded radio signals from the console means 14. The remote control means 18 is a radio signal transmitter for arming and disarming the console means 14 from a remote location. The entrance monitoring means 12 is a normally closed switch between a wall and a door or window which transmits coded radio signals when opened.

The console means 14 has an armed mode and disarmed mode for receiving the intrusion coded signals from the entrance monitoring means 12 indicating that an entrance has been opened or intruded when the console means 14 is in the armed mode. The console means 14 may be placed in the armed and disarmed modes either remotely by the remote control means 18 or by the console means 14 itself, as explained subsequently. When the console means 14 is in the armed mode, any received intrusion coded signal from the entrance monitoring means 12 will command the console means 14 to transmit an alarm radio signal to the alarm means 16 to produce an indication signal, or more specifically an audible signal. Upon receipt of an intrusion coded signal in the disarmed mode, the console means 14 will not transmit a alarm radio signal to the alarm means 16.

To arm and disarm the console means 14, the remote control means 18 includes arm button means 20 to be manually depressed to set the console means 14 in the armed mode by transmitting an arming coded radio signal. A disarm button means 22 is included to be manually depressed to set the console means 14 in the disarmed mode by transmitting a disarming coded radio signal. If the arm button means 20 or disarm button means 22 is depressed for a predetermined time, such as 2 seconds, the console means 14 will immediately turn on the alarm means 16 for panic operation, as will be described subsequently. For normal operation of the arm 20 or disarm 22 button means, the buttons 20, 22 need be momentarily depressed, i.e. ½ second. If the arm button means 20 is depressed more than once in a 5 second period, a long tone is produced by the alarm means 16.

The console means 14 includes arming switch means 24 for setting the assembly 10 in the armed mode. Therefore, the assembly 10 may either be set in the armed mode by the arm button means 20 on the remote control means 18 or by the arming switch means 24 on the console means 14. Also included is test switch means 26 for setting the console means 14 in a test mode to test the entrance monitoring means 12 for proper operation, as will be described subsequently. A panic switch means 28 is included for immediately turning on the remote alarm means 16 in cases of emergency. Also included is disarming switch means 30 for setting the assembly 10 in the disarmed mode, and for turning off the audible signal of the alarm means 16, and for exiting the test mode, and for turning off an intrusion indicator, as will be subsequently described.

The console means 14 includes an armed indicator means 32 for audibly indicating that the console means 14 has been set in the armed mode by the remote control means 18. There is an armed LED 34 on the console means 14 for visibly indicating that the assembly 10 is in the armed mode. When the assembly 10 is set in the armed mode by the remote control means 18, a short beep will be produced by the alarm means 16 indicating this setting. If a short beep is not produced upon "arming", this will indicate that the assembly 10 is not armed or properly working. The short beep is produced by a beep generator 33 producing a short alarm radio signal. The console means 14 also includes an intrusion indicating means 36 for indicating that an entrance monitoring means 12 has previously opened in the armed mode, or in other words that the alarm means 16 has sounded. The intrusion indicating means 36 audibly indicates when the entrance monitoring means 12 has been previously opened. This is accomplished by depressing the disarm button means 22 of the remote control means 18 which will sound a beep from the alarm means 16. The beep generator 33 is responsive to the intrusion indicating means 36 to produce the alarm radio signal. Also included is an intrusion visual indicator 38 on the console means 14 which can only be disarmed or turned off by the disarming switch means 30 of the console means 14. Therefore, if an intrusion has occurred between arming and returning to the secured area and the alarm means 16 is not still sounding, a beep will be produced when the console means 14 is disarmed by the remote control means 18. This may indicate that there may be reason to believe an intruder is still on the premises. During normal disarming, no sound or beep is produced.

When the console means 14 is in the armed mode, and an intrusion occurs sensed by the entrance monitoring means 12 or through panic operation, the console means 14 sends the alarm radio signal to the alarm means 16 for sounding the alarm. The console means 14 includes timer means 40 for transmitting the alarm radio signal for a predetermined time. Upon intrusion, a continuous sound is produced by the alarm means 16 in absence of the disarming. The alarm means 16 will sound for a predetermined time, such as five minutes, at which time the console means 14 stops sending the alarm radio signal which effectively turns off the alarm means 16. The sounding of the alarm means 16 may also be disabled by the disarm button means 22 of the remote control means 18 or the disarming switch means 30 of the console means 14 prior to the timer means 40 which turns off the alarm means 16 after a 3 or 4 second delay.

The operation of the test mode which is set by depressing the test switch means 26 on the console means 14 is as follows. When the test switch means 26 is depressed, a test latch 27 is set indicative of the test mode. When in the test mode, a test indicator means 42 visually indicates that the test switch means 26 has been depressed and the console means 14 is in the test mode. Each entrance monitoring means 12 may be checked individually by opening each door or window which will sound a short beep by the alarm means 16 indicating that the system works properly. The alarm radio signal representing a beep is sounded by a test beep generator 29. When in the test mode, a beep is not sounded when depressing the arming switch means 24 to protect against the situation where a consumer leaves the house forgetting the system is in the test mode. In this situation, no beep is sounded in attempting to arm the system 10 so that the consumer will be alerted that the system 10 has not been armed and may still be in the test mode. Recalling, arming the system by the arm button means 20 will produce a short beep by the alarm means 16 indicating that the console means 14 has been set in the armed mode. The console means 14 is removed from the test mode by depressing the disarming switch means 30.

The coded radio signals transmitted by the console means 14, remote control means 18, and the entrance monitoring means 12, and the coded radio signals received by the alarm means 16 and console means 14 may be any number bit coded signals. In the preferred embodiment, a nine bit coded signal is chosen. The consumer may choose the nine bit code simply by cutting jumpers or using dip switches to produce the code in all the entrance monitoring means 12, remote control means 18, console means 14 and alarm means 16. The nine bit coded signals from the remote control means 18 and the entrance monitoring means 12 are compared within the console means 14 for proper detection and activation of the alarm means 16. The actual transmitted code is an 18 pulse code which is detected as pairs so that there is only 9 actual inputs and outputs. The ninth pulse in the assembly 10 is not user-selectable. The nine bit coding is used for security purposes; the nine bit code has a high probability of receiving a correct signal and a low probability of receiving a wrong signal. Additionally, one system 10 will only activate its own components 12, 14, 16, 18 without interfering with systems of other consumers or different locations. Typical range for the radio coded signals is 75–100 ft., which may be altered by the circuitry.

Figure 2:
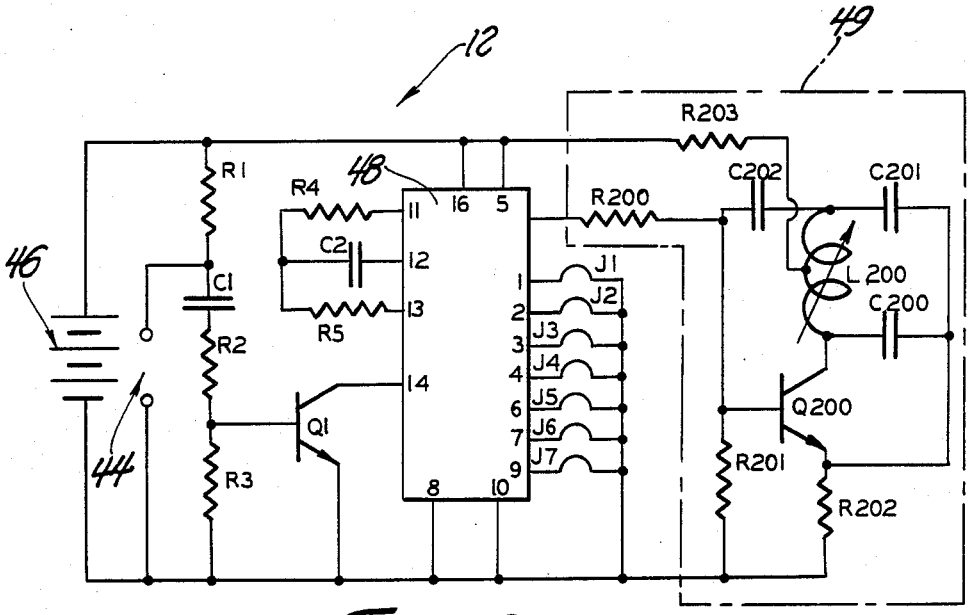
FIG. 2 is a schematic diagram of the entrance monitoring means.

The entrance monitoring means 12 may be attached to any door and adjacent molding strip or wall, or to any window and adjacent molding strip or wall, or some other type of movable object and stationary object to be monitored. Any number of entrances may be monitored by using a plurality of entrance monitoring means 12. As illustrated in Fig. 1, the entrance monitoring means 12 uses a magnetic switch 44, 45 and a battery 46 to detect intrusion. The intrusion coded signal, which is coded nine bit radio signal, is sent to the console means 14 each time the switch 44 is pulled away from the stationary magnet 45 by intrusion or the opening thereof. The entrance monitoring means 12 is a normally closed system. This normally closed switch conserves battery life because a half second signal is sent only when a door or window is opened. This signal is only sent upon the opening of the switch 44, such that if the door or window is left open, the signal will not be continuously transmitted therefor conserving battery life. When the console means 14 receives this intrusion coded signal after having been armed, it indicates intrusion by the intrusion LED 38 and instantly signals the alarm means 16 to activate. Multiple monitoring means transmitters 12 may be used. The intrusion coded signal is sent when any of the sensor switches 44 is opened. The actual circuitry of the entrance monitoring means 12 is shown in FIG. 2 and includes the battery 46 and the magnetic switch 44 which shorts the input signal through a first resistor R1 to an entrance encoder chip 48 when the switch 44 is closed. When the switch 44 is opened, a transistor Q1 pulls the input pin 14 of the entrance encoder chip 48 to ground and the entrance encoder chip 48 transmits through a radio transmitter circuit 49 the intrusion coded signal which is received by the console means 14. An R-C time constant comprising first capacitor C1 and resistive divider R2, R3, holds the transistor Q1 in this state until the intrusion coded signal is completely transmitted. The entrance monitoring means 12 includes a series of jumpers J1–J7 connected to the entrance encoder chip 48 which are to be cut by the consumer to determine the coding. Any combination may be cut, but this first coded combination must be mirrored at the console means 14. The coded inputs of the entrance encoder chip 48 are on pins 1–7, 9, 10, where pin 5 is set high and pin 10 is set low. External timing of the chip 48 is determined by resistor R4 connected to pin 11 and connected to resistor R5 to pin 13, and capacitor C2 connected to resistors R4, R5 and pin 12. Pin 16 is held high and pin 8 is held low. The output signal is at pin 15 to the transmitter circuit 49.

Figure 5:
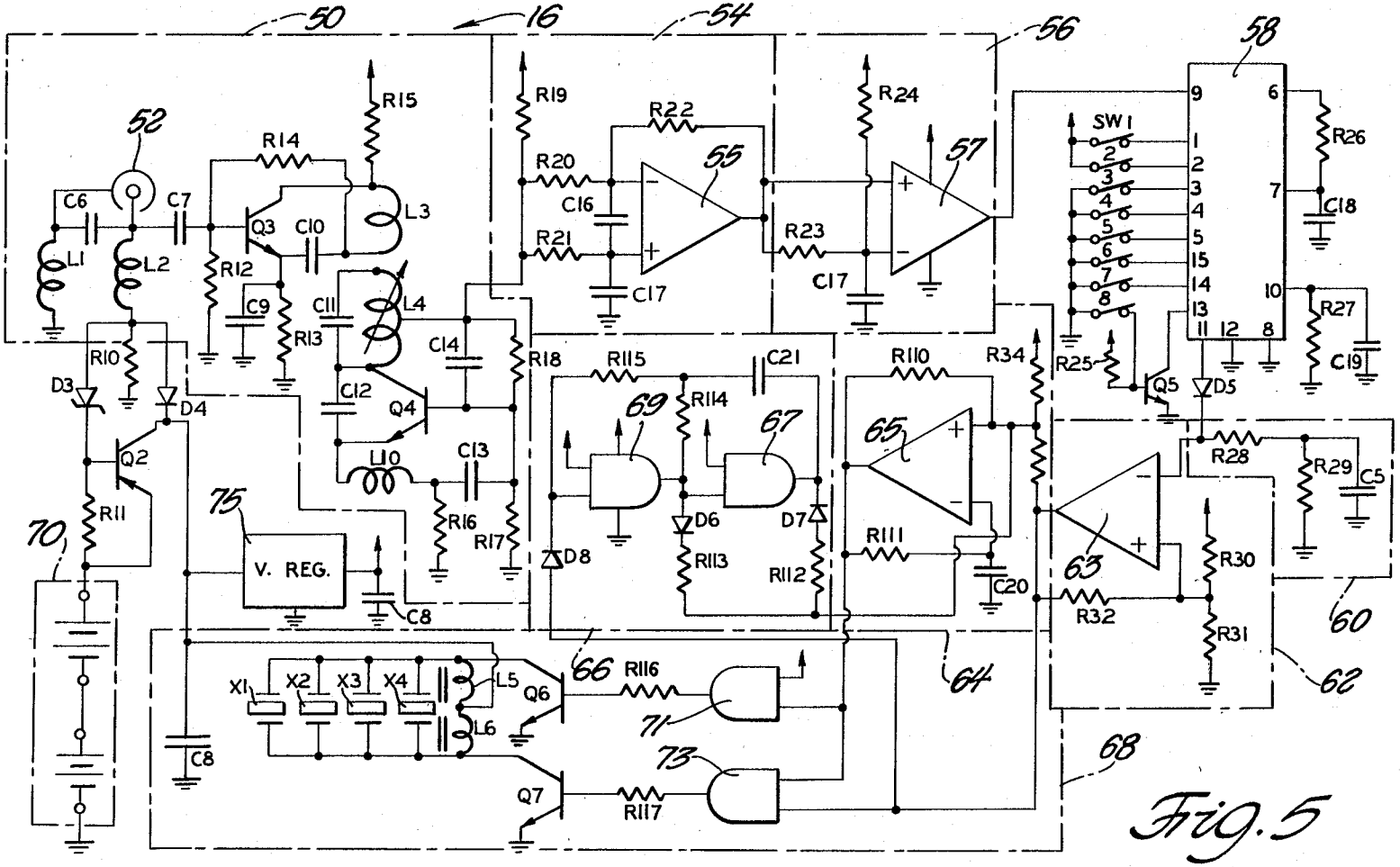
FIG. 5 is a schematic diagram of the remote power alarm means.

The alarm means 16 may solely produce an audible signal and/or be connected to transmit an emergency signal over telephone lines to police or the like. The console means 14 may also be adapted to transmit emergency signal over telephone lines to police or the like. There may be multiple alarms 16 which are coded the same. As illustrated in FIG. 5, the alarm means 16 includes alarm receiver means 50 for receiving and detecting the alarm radio signal producing an alarm signal. The alarm receiver means 50 includes a power jack 52 to be connected to the wall voltage or standard household outlet. The power lead 52 can be used for an antenna. If the alarm means 16 is to be powered by battery only, an antenna may be plugged into the power jack 52. An alarm amplifier means 54 amplifies the alarm signal producing an amplified alarm signal. An alarm limiter means 56 receives the amplified alarm signal and limits the magnitude of the amplified alarm signal producing an alarm limited signal. An alarm decoder means 58 receives the alarm limited signal and decodes it to produces a pulse signal. The alarm decoder means 58 includes switches SW1–SW8 to be set to the consumer selector combination, this second combination code must be the same combination as that on the console means 14. The eighth bit of the code is inverted by the console means 14 and the alarm means 16 detects the eighth inverted bit. The inverting of the bit prevents detection and activation of the alarm means 16 by the remote control means 18. A storage means 60, in the form of a capacitor C5, receives a pulse signal and holds its magnitude above a predetermined limit. A trigger means 62 produces a control signal when the storage means 60 is above the predetermined limit. First 64 and second 66 frequency oscillator circuits produce a dual tone frequency signal in response to the control signal. An audible means 68 converts the dual tone frequency signal into an indication signal or audible signal. The alarm means 16 includes power back-up means 70 to power the alarm means 16 in case of power failure to the secured premises in the wall outlet 52. The power back-up means 70 includes batteries 72. The alarm receiver means 50 includes the power jack/antenna 52 received by a first inductors L1 and second L2. A capacitor C6 is connected between inductors L1 and L2. A capacitor C7 is connected to the power jack 52 and the base of a transistor Q3 and to a resistor R12 to ground. The inductors L1, L2 and capacitors C6, C7 act as filters. The inductor L2 is connected to resistor R10 to ground, and to a zener diode D3 and a diode D4. A transistor Q2 has its collector connected to diode D4 and its base connected to zener diode D3. A resistor R11 is connected to the base of transistor Q2 and to the series batteries 72 used as backup. A voltage regulator 75 is connected to the collector of transistor Q2 and to a capacitor C8 to ground. The d.c. power of voltage regulator 75 is applied to balance the circuitry via L1, L2. The radio coded signal on d.c. power leads is applied to the base of transistor Q3 via capacitors C6, C7 with the voltage regulator 71 on across resistor R10, the transistor Q2 is off. With the voltage regulator 75 off, transistor Q2 is on with the batteries 70 supplying power. The emitter of transistor Q3 is connected to capacitor C9 to ground and resistor R13 to ground. A coil L3 is connected between the collector and the emitter via capacitor C10. A resistor R14 is connected to the base to capacitor C10, and resistor R15 is connected to the coil L3 and power. Coil L3 is coupled to a second coil L4 parallel with capacitor C11. A second transistor Q4 has its collector connected to the coil L4 and a capacitor C12 between the collector and emitter. An inductor L10 is connected to the emitter and to a resistor R16 to ground, and a capacitor C13 to a resistor R17 to ground. The base of the transistor Q4 is connected to resistor R17, and to a parallel capacitor C14 and resistor R18 tapping the second coil L3 producing the alarm signal. The alarm amplifier means 54 includes three resistors R19, R20, R21 receiving the alarm signal: first resistor R19 connected to power, second resistor R20 connected to the inverting input, and third resistor R21 connected to noninverting input of an operational amplifier 55. A first capacitor C15 is connected to the non-inverting input and ground, and a second capacitor C16 is connected between the input terminals of op-amp 55. A feedback resistor R22 is connected to the inverting terminal, the output of the op-amp 55 producing the amplified alarm signal. The alarm limiter means 56 receives the amplified alarm signal and includes an op-amp 57 directly receiving the amplified alarm signal at its non-inverting input, and through resistor R23 to the inverting input. A second resistor R24 is connected to the inverting input power and a capacitor C17 is connected to the inverting input and ground. The output of the opamp 57 produces the alarm limited signal which is received by the alarm decoder means 58 at pin 9. The switches SW1–SW8 are connected to pins 1–5, 13–15. Switch 8 is connected through an inverting circuit to pin 13, which comprises: a resistor R25 connected to the switch and to power, and a transistor Q5 with its emitter grounded and its base connected to SW8 and resistor R25 and the collector connected to pin 13. Pin 6 is connected to timing circuit comprising resistor R26 also connected to pin 7 which is connected to capacitor C18 to ground. Pin 10 is connected to parallel resistor R27 and capacitor C19. The output on pin 11 is isolated by diode D5 which produces the pulse signal. The pulse signal is received by the storage means 60 which includes a resistor R28 connected to the capacitor C5 to ground, and a resistor R29 connected to capacitor C5 and ground. The trigger means 62 includes an op-amp 63 which receives the storage means on its inverting terminal. The noninverting terminal is connected to a voltage divider comprising resistor R30 connected to power and resistor R31 connected to ground, and including a feedback resistor R32. The trigger means 62 is configured as a Schmitt trigger. The output of the op-amp 63 is fed through a voltage divider circuit comprising resistor R33 receiving the output of the op-amp 63 and connected to resistor R34 which is connected to power. Resistor R33 produces the control signal which is received by the first 64 and second 66 frequency oscillator circuit. The first frequency oscillator circuit 64 includes an op-amp 65 which receives the control signal at its noninverting input, and includes a feedback resistor R110 connected to the noninverting input. A capacitor C6 is connected to the inverting input and ground, and the feedback resistor R111 is connected to the capacitor C6 and the output op-amp 65. The second frequency oscillator circuit 66 includes two NAND gates 67, 69. The control signal is fed through a resistor R113 to a reverse bias diode D6 to one of the inputs of the NAND gate 67 wherein the other input is held high. A resistor R114 is connected to the diode D6 which is connected to the output of NAND gate 69. A capacitor C7 is connected between resistor R114 and the output of NAND gate 67, which is connected to a reverse diode D7 to resistor R112 to the control signal. A resistor R115 is connected to resistor R114 and to the input of NAND gate 69, and to diode D8 which produces the output signal, the other input of NAND gate 69 is held high. The audible means 68 includes a first 71 and second 73 NAND gate. The first NAND gate 71 has one input held high and the other input is connected to the output of the first frequency oscillator circuit 64. The second NAND gate 73 has an input connected to the output of the first frequency oscillator circuit 64 and the second input is connected to the output of the second frequency oscillator circuit and op-amp 63 of the trigger means 62. The output of the first NAND gate 71 is connected to resistor R116 which is connected to the base of transistor Q6 having its emitter connected to ground and the output of the second NAND gate 73 is connected through resistor R117 to a second transistor Q7 having its emitter grounded. The collectors of both transistor Q6, Q7 drive two coils L5, L6 which causes oscillation of ceramic disks or transducers X1–X4. The ceramic disks used are made by MuRata model number 7BB-35-3AO, but any transducer may be used. A capacitor C8 taps the center of coils L5 and L6 connecting to ground.

Figure 3:
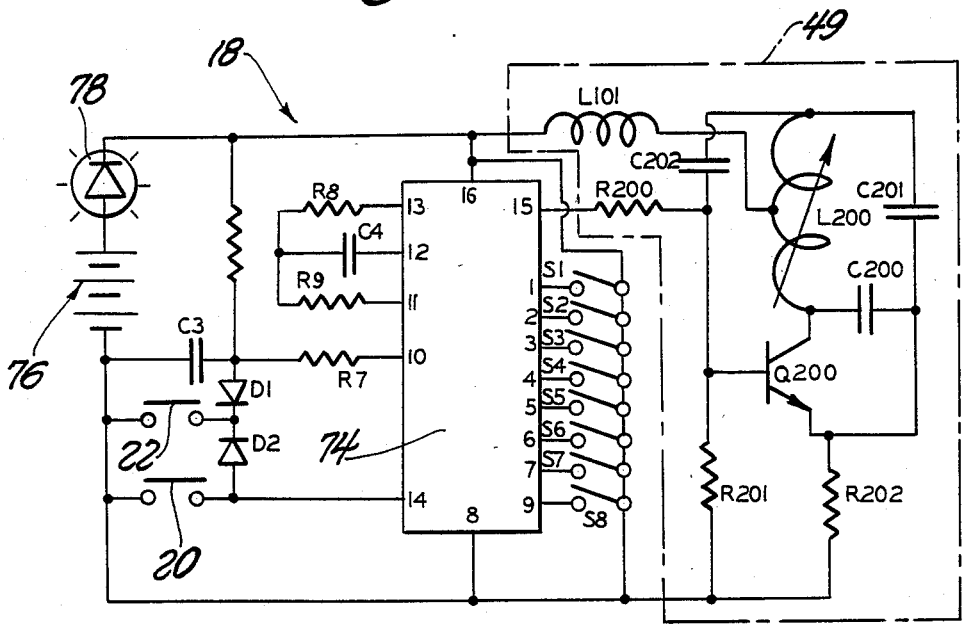
FIG. 3 is a schematic diagram of the remote control means.
Figure 4:
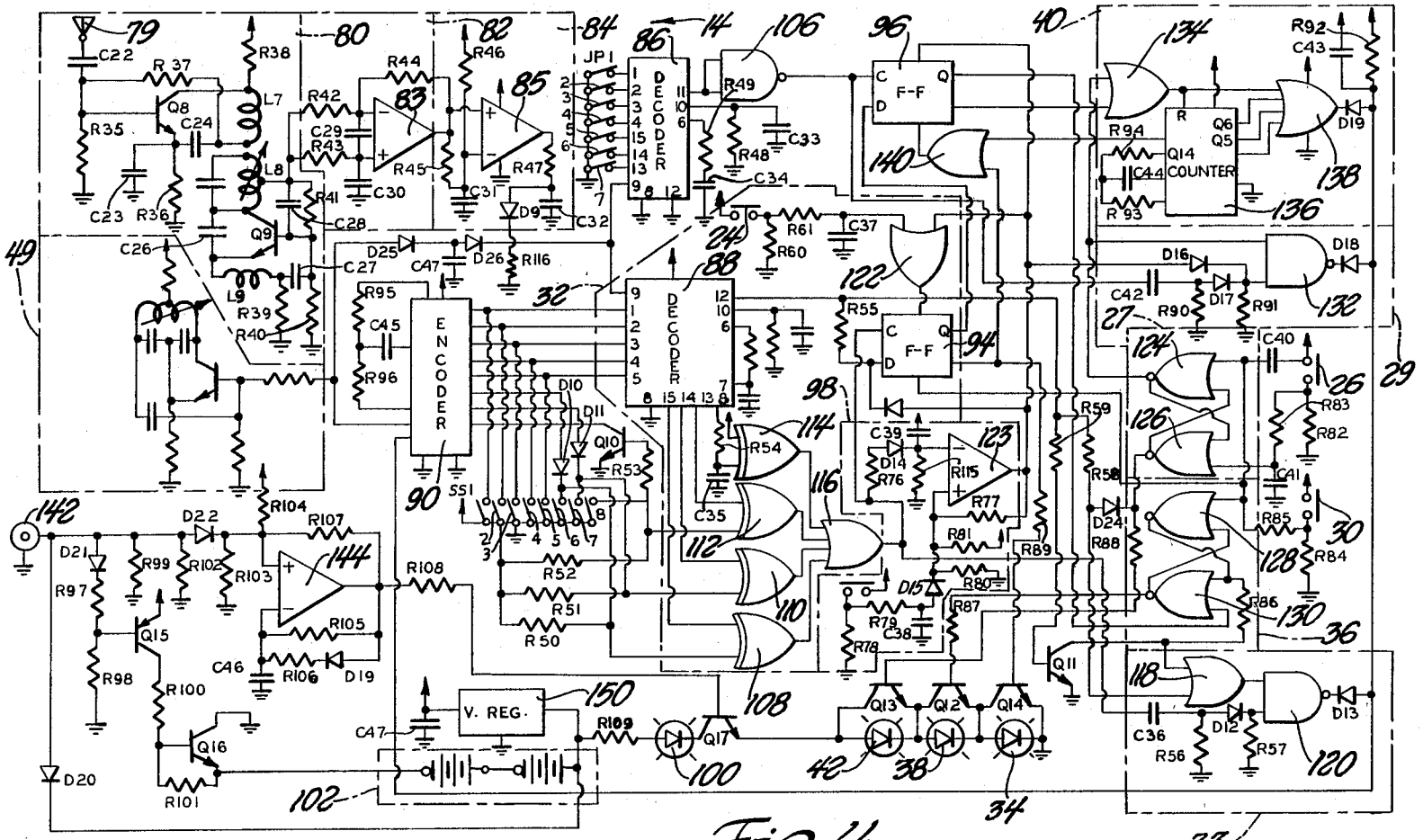
FIG. 4 is a schematic diagram of the console means.

As previously stated, the remote control means 18 includes arm 20 and disarm 22 button means. By using the remote control means 18, there are no delays in the system for exiting or entering the secured premises. As indicated in FIG. 3, also included is a remote control encoder means 74 responsive to the arm 20 and disarm 22 button means. The remote control encoder means 74 includes switches S1–S8 for selecting the coding of the transmitted radio signal. As previously stated, this second coding combination is consumer selected and should be the same combination as the console means 14 and the alarm means 16. An R-C time constant circuit comprising resistor R6 and capacitor C3, allows a battery 76 to supply power to the remote control means 18 in order to transmit the full length of arming and disarming coded radio signals. The battery 76 is connected in series with a transmitting indication means which is an LED 78 which is connected to the resistor R6. The capacitor C3 is connected to the battery 76 and resistor R6. A resistor R7 is connected to the RC time constant circuit R6, C3 and to pin 10 of the encoder 74. A reversed biased diode D1 is connected to the RC time constant circuit R6, C3 and to the disarm button means 22, which is connected to the battery 76. A forward biased diode D2 is connected to the arm button means and pin 14, and the reversed biased diode D1, the arm button means 20 connected to the battery 76. When the arm button means 20 is depressed, pin 14 of the remote control encoder 74 means is held low and pin 10 is pulled high. The transmitting LED 78 is illuminated when either of the buttons 20, 22 is depressed and a coded radio signal is transmitted. When the disarm button means 22 is depressed, pin 14 is held low as is pin 10 of the remote control encoder means 74. Therefore, pin 10 is the ninth data bit in the transmitted coded signals which distinguishes the arming coded radio signal and the disarming coded radio signal. A resistor R8 is connected to pin 13 of the encoder 74 and to a resistor R9 to pin 11, and to a capacitor C4 and pin 12. Pin 16 is held high and pin 8 is grounded. Pins 1–7, 9 are connected to the switches S1–S8. Pin 15 of the encoder 74 is the coded radio signal output to the standard transmitter circuit 49. In the transmitter circuit 49, resistor R103 is replaced by a coil L101.

The console means 14 includes console receiver means 80 for receiving the coded radio signals from the remote control means 18 and the entrance monitoring means 12 to produce a detected signal. An audio amplifier means 82 amplifies the detected signal producing an amplified signal. A limiter means 84 limits the magnitude of the amplified signal producing a coded signal. The console means 14 includes an entrance monitor decoder means 86 for receiving and decoding the coded signal producing an intrusion signal when the entrance monitoring means 12 has produced an intrusion coded signal indicating that the entrance has been opened. The entrance monitor decoder means 86 includes a series of jumpers JP1-7 to be cut in the same first combination code as each of the entrance monitoring means 12. The armed indicator means 32 includes a controller decoder means 88 for receiving and decoding the arming coded radio signal and the disarming coded radio signal to produce a mode signal representative of the mode the console means 14 is to be set. The controller decoder means 88 includes code switches SS1-8 to be set in the same second combination code as the remote control means 18 and alarm means 16. The console means 14 also includes alarm encoder means 90 for encoding and producing a coded alarm signal in response to the timer means 40 and the beep generator 33 and the test beep generator 29. The coding of the alarm signal is determined by the switch settings SS1–SS8 It should be realized that any switches, jumpers or the like may be used to select the coding. In the alarm encoder means 90, the eighth bit is inverted as in the alarm means 16 and explained prior. An alarm transmitter means 49 receives the coded alarm signal and transmits it to the alarm means 16 for activation thereof. The console means 14 includes armed flip flop means 94 for storing the mode signal and the arming switch means 24 and the disarming switch means 30 for setting the console means 14 in the armed mode and the disarmed mode by producing an armed signal representative of the mode. An alarm flip-flop means 96 receives the intrusion signal and the armed signal to initiate the timer means 40. The console means 14 includes panic means 98 for receiving an expanded coded radio signal from the remote means or the panic switch means 28. The test beep generator 29 is responsive to the panic means 98 and to the panic switch means 28 to produce an alarm radio signal to produce a beep, The console means 14 includes power indication means 100 for visually indicating when power is being supplied to the console means 14 by a continuous indication and by a chopped indication when the battery back-up 102 is being used.

The console receiver means 80 includes an antenna 79 receiving coded radio signals from the entrance monitoring means 12 and the remote control means 18 and through a capacitor C22 and to a resistor R35 to ground. The transistor Q8 connected through has its base connected to the capacitor C22 and to the resistor R35. The emitter of the transistor Q8 is connected to a second resistor R36 and ground, a second capacitor C23 and ground, and a third capacitor C24. A third resistor R37 is connected to the first capacitor C22 and to the third capacitor C24. A first coil L7 is connected to the collector of the transistor Q8 and to the third capacitor C24. One side of the coil L7 is connected to a fourth resistor R38 to power. The other side of the coil L7 is coupled to a second coil L8 which is parallel with a fourth capacitor C25. A second transistor Q9 has it collector connected to the other end of the second coil L8 and to a fifth capacitor C26 which is connected between the collector and the emitter. The emitter is also connected to an inductor L9 which is connected to a fifth resistor R39 and ground, and a sixth capacitor C27 is connected to an additional resistor R40 and ground. The base of the second transistor Q9 is connected to parallel capacitor C28 and resistor R41 circuits which produces the received signal.

The audio amplifier means 82 includes a pair of resistors R42, R43 receiving the received signal and connected to the inverting and noninverting inputs of an operational amplifier 83. A capacitor C29 is connected between the inputs of the amplifier 83, and the second capacitor C30 is connected to the noninverting input and ground. A feedback resistor R44 is connected to the inverting input of the operational amplifier 83. The limiter means 84 includes an operational amplifier 85 receiving the amplified signal at its noninverting input. A resistor R45 receives the amplified signal and is connected to the inverting input, a capacitor C31 is connected between the inverting input and ground, and a second resistor R46 is connected to the inverting input and power. The output of the operational amplifier 85 is connected to a third resistor R47 to a capacitor C32 and ground, and to a diode D9 producing the coded signal. The input pin 9 of the entrance monitor decoder means 86 receives the output of the diode D9, as does pin 9 of the controller decoder means 88. The entrance monitor decoder means 86 receives consumer selected jumpers JP1-7 at pins 1, 2, 3, 4, 15, 14, 13 which are the first combination coding as in the entrance monitor means 12. Pins 5 and 16 are connected to power and pins 8 and 12 are connected to ground. Pin 11 is the output from the monitored decoder means 86 which is received by a NAND gate 106 at both inputs. Pin 10 is connected to an RC time constant comprising resistor R48 and capacitor C33 in parallel, and pins 6, and 7 are connected therebetween by resistor R49, and pin 7 is connected to a capacitor C34 and ground. The output of the NAND gate 106 is connected to the alarm flip-flop means 96 at the clock input, the alarm flip-flop means 96 being a D flip-flop. The output of NAND gate 106 is also connected to the test beep generator 29. The armed indicator means 32 includes the controller decoder means 88 receiving its input on pin 9. Pins 1, 2, 3, 4, and 5 are connected to the consumer selectable switches SS1-8. Pin 8 is connected to ground. Connections of pins 10, 6 and 7 are the same as the connections of the entrance monitor decoder means 86. Pin 12 is the armed/disarmed data bit 9. This bit is low if armed and high if disarmed. Pin 12 is effectively connected to the beep generator 33 and D input of the armed flip-flop 94. The pins 15, 14 and 13 are each connected to one input of an exclusive OR gates 108, 110, 112. The second input of the first exclusive OR gate 108 is connected to power through resistor R50 and switch SS6 switching to ground. The second input of the second exclusive OR gate 110 is connected to power through resistor and switch SS7 switching to ground. The second input of the third exclusive OR gate 112 is connected to switch SS8 and via resistor R52 to power and to resistor R53 to the base of inverting transistor Q1O. Switches SS6 and SS7 include blocking diodes D10, D11 to code the encoder 90. Pin 11 is connected via an RC time constant R54, C35 to a fourth exclusive OR gate 114 with a second input connected high. The output of the exclusive OR gates 108, 110, 112, 114 are low when the inputs are equal. The output of the exclusive OR gates 108, 110, 112, 114 are connected to a single OR gate 116. The output of the single OR gate 116 is connected to the clock input of the armed flip-flop means 94. The D input is connected through the resistor R55 to pin 12 of the controller decoder means 88. The beep generator 33 is connected to the output of the OR gate 116, and which includes an OR gate 118 connected to a NAND gate 120. The output of the OR gate 116 is ac coupled through a capacitor C36 and resistor R56 time constant to a diode D12 to a resistor R57 to ground and to an input of the NAND gate 120. The output of the NAND 120 gate is connected to reverse bias diode D13 producing the alarm radio signal to the input of the alarming encoder means 90. The other input of the NAND gate 120 is connected to the output of OR gate 118. One input of the OR gate 118 is connected through resistor R58 to the output of pin 12 on the controller decoder means 88 and the second input is connected to the collector of a transistor Q11 with emitter grounded and base connected to pin 12 via resistor R59. The arming switch means 24 is connected to resistor R60 and ground, and to resistor R61 to a capacitor C37 and ground, and to the input of an OR gate 122 which is connected to the select of the armed flip-flop means 94. The output of OR gate 116 is connected to the panic means 98, the gate 116 connect to resistor R76 and diode D14 and RC circuit R115, C39 to the inverting input of an operational amplifier 123 having feedback resistor R77 connected to the noninverting input, the output of which is connected to the select of the alarm flip-flop means 96 and to the test beep generator 29. The panic switch means 28 is connected to a resistor R78 at ground and to a resistor R79 and capacitor C39 and ground, to a diode D15 to the noninverting input of the operational amplifier 123. A resistor R80 is connected to the noninverting input and ground and resistor R81 is connected to the noninverting input and power. The panic mode is caused by the panic switch means 24 pulling up the non-inverting input of op-amp 123, or by a long arm or disarm coded signal which allows capacitor C39 to charge toward zero. When the panic mode is operated, the arm flip-flop 94 is set in the armed mode.

The test switch means 26 is connected to the test latch 29 and disarming switch means 30 is connected to the intrusion indicating means 36, which is a latch. Test switch means 26 is connected to resistor R82 to ground and the other terminal of the switch 26 connected to power. Connected to the power terminal is capacitor C40 connected to the input of a first NOR gate 124, and the second NOR gate 126 with its output connected to the input of the first NOR gate 124; NOR gate 124 output is connected to the input of the second NOR gate 126. The second input of the second NOR gate 126 is connected to the second terminal of the test switch 26 and resistor R82 through resistor R83 and connected to capacitor C29 to ground. The output of the first NOR gate 124 is connected to the timer means 40, and the output of the second NOR gate 126 controls the test indicator means 42. The disarming switch means 30 includes two terminals one connected to power and the other connected through ground via a resistor R84 and connected through resistor R85 to the input of a third NOR gate 128. Also included is a fourth NOR gate 130 having an input connected to the output of the third NOR gate 128, and the third NOR gate 128 having one of its inputs connected to the output of the fourth NOR gate 130. The other input of the fourth NOR gate 130 is connected to the Q output of the alarm flip-flop means 96, and the other input which is connected to NOR gate 128 is connected via the resistor R86 to the collector of transistor Q11. The output of NOR gate 130 is connected resistor R87 to the base of transistor Q12 to drive the intrusion LED 38. The output of the second NOR gate 126 is connected via resistor R88 to the base of transistor Q13 driving the test LED 42. A reverse bias diode D24 interconnects the output of second NOR gate 126 to resistor R58. The $\overline{Q}$ output of armed flip-flop 94 drives the base of transistor Q14 via resistor R89 driving the armed indicator 34. The test beep generator 29 includes the NAND gate 132 with an input connected to the output of the first NOR gate 124, and a second output connected via diode D16 to the output of op-amp 124, and also connected to the output of decoder 86 through capacitor C42 connected to resistor R90 to ground, to diode D17 to resistor R91 to ground, to the input of NAND gate 132, the output of the NAND gate 132 is connected via a reverse biased diode D18 to the input of the encoder 90. The timer means 40 includes an OR gate 134 with inputs connected to the $\overline{Q}$ output of alarm flip-flop means 96 and to the first NOR gate output 124, the output of OR gate 134 is connected to the reset pin of counter 136. Pins 4, 5, and 6 of the counter 136 are connected to OR gate along with the output of OR gate 134, the output of OR gate 138 is connected via a reverse bias diode D19 to the encoder input 90. The input of the encoder 90 is connected to resistor R92 to power, and to capacitor C31 to power. The counter chip 136 has external timer circuits comprising resistor R94, resistor R93, and capacitor C44. An OR gate 140 receives an input from counter 136 and from the $\overline{Q}$ output of armed flip-flop 94 producing an output to reset alarm flip-flop 96. The timer 40 is held rest by the test latch 29 or by the Q output of the alarm flip-flop 96.

The encoder 90 receives the switches SS1-8 to produce the alarm radio coded signal to be transmitted via the standard transmitting circuit 49. The encoder includes external timing resistors R95, R96, and a capacitor C45. The output pin 14 of the encoder 90 is also connected to diode D25 to capacitor C47 grounded, to diode D26 connected to resistor R116 to ground and to diode D9. The console means 14 is powered through the power supply from an ac outlet 142. The outlet 142 is connected via a diode D20 to a resistor R109 through the power indicator means 100 which is connected to the collector of transistor Q17. A voltage regulator 150 is connected to the power and capacitor C47 to ground which produces the 8 volt supply to the circuitry of the console means 14. Series batteries 102 is connected to the voltage regulator 150 and resistor 109 junction. A diode D21 is connected to the output 142 and to resistor R97 connecting to the base transistor Q15, the base also connected to resistor R98 and ground. The emitter is supplied power and the collector of transistor Q15 is connected to resistor R100 to the base of transistor Q16 including a common base emitter resistor R101 and connected to the battery back up 102. A resistor R99 is connected to the outlet 142, and parallel with the resistor R102. Diode D22 is connected to the outlet 142, and to a resistor 103 to ground. Resistor R104 is connected between power and diode D22 and to the noninverting input of an operational amplifier 144 including a feedback resistor R107 connected to the noninverting input. The inverting input is connected to a feedback resistor R105 and the feedback resistor R106 in series with diode D19 and to capacitors C46 and ground. The output of operational amplifier 144 is connected to the resistor R108 to drive the base of transistor Q17 for illuminating LED 100 or flickering in the case of battery use.

Each of the transmitter circuits 49 are configured as like circuits. The coded signal to be transmitted is received by a voltage divider circuit comprising two resistors R200, R201. A transistor Q200 receives the signal from the voltage divider circuit R200, R201 to amplify the coded signal. An emitter resistor R202 is connected to the emitter of the transistor Q200 and to ground. The collector of the transistor Q200 is connected to an oscillating circuit comprising an inductance coil L200 and a first capacitor C200 connected to the emitter of the transistor Q200. The other side of the coil L200 is connected to a second capacitor C201. The first C200 and second C201 capacitors are also connected to the emitter of the transistor Q200. A third capacitor C202 is connected to the coil L200 and to the junction of the voltage divider circuit R200, R201. The inductance coil L200 is tapped by a resistor R203 connected to the power source. There is also a method for indicating when a closable entrance has been intruded based on the above defined apparatus. The method includes the steps of monitoring the entrance for intrusion, producing the intrusion coded signal in response to intrusion of the entrance, transmitting the alarm radio signal in response to the intrusion coded signal, receiving the alarm radio signal, and producing an intrusion indication signal in response to the alarm radio signal.

The following is a list of electronic components used in the preferred embodiment. It is to be understood that other values and components may be used, the invention is not limited thereto.

LIST OF COMPONENTS

| Capacitors | Values (Farads) |
|---|---|
| C6, C7, C9, C10, C14, C22 C23, C24, C28, C41 | 100 |
| C11 | 2p |
| C12, C25 | 3.3p |
| C36, C44, C47 | 10n |
| C26 | 5p |
| C38, C43, C46 | 1u |
| C2, C4, C13, C16, C18, C20, C27, C29, C32, C34, C45 | 1n |
| C8, C35 | 100u |
| C3, C5, C31, C37, C39, C40 | 10u |
| C15, C17, C30 | 4.7u |
| C19, C33 | 22n |
| C1, C21, C35 | 47n |
| C42 | 4.7n |

-continued

LIST OF COMPONENTS

| Diodes | Type |
|---|---|
| D1, D2, D5, D6, D7, D8, D9–D19, D21, D22 | 1N3904 |
| D3 | 1N4740 |
| D4, D20 | 1N4004 |
| **Transistors** | **Type** |
| Q1 | 9014 |
| Q3, Q4, Q8, Q9 | MPS-HI0 |
| Q2, Q15 | 2N3906 |
| Q5, Q6, Q7 | 2N4401 |
| Q10, Q11, Q12, Q13, Q14, Q16, Q17 | 2N3904 |
| **Integrated Circuits** | **Type** |
| 74, 86 | MC145026 |
| 69 | 78L08 |
| 55, 57, 63, 65, 83, 85, 123, 144 | LM324 |
| 58 | MC145028 |
| 67, 69, 71, 73, 108, 110, 112, 114 | 4070 |
| 48, 90 | MC145026 |
| 88 | MC145027 |
| 94, 96 | CD013BE |
| 106, 132 | CD4011BE |
| 116, 138 | 4072 |
| 120 | 4011 |
| 118, 122, 134, 140 | 4071 |
| 124, 126, 128, 130 | 4001 |
| 136 | 4060 |
| **Resistors** | **Value (Ohms)** |
| R13, R15, R36, R38 | 1k |
| R7, R11, R12, R14, R18, R20, R21, R23, R25, R28, R35, R37, R42, R43, R45, R60, R78, R79, R82, R84, R108, R201 | 10k |
| R2, R5, R6, R8, R30, R31, R32, R33, R50, R51, R52, R76, R80, R81, R102, R104, R107, R103 | 100k |
| R1, R22, R24, R44, R53, R54, R56, R57, R59, R90, R91, R105, R113 | 1M |
| R3, R4, R9, R96 | 220k |
| R10, R94 | 2.2k |
| R16, R39 | 470 |
| R17, R40 | 3.3k |
| R19 | 3.9k |
| R26, R46 | 390k |
| R27, R46, R48 | 330k |
| R29 | 270k |
| R34 | 133k |
| R110 | 115k |
| R111 | 237k |
| R112 | 750k |
| R114 | 4.7M |
| R109, R116, R117 | 4.7k |
| R47, R93 | 910k |
| R55, R58, R86, R88 | 47k |
| R61, R83, R89, R106, R200 | 22k |
| R115 | 300k |
| R77 | 150k |
| R92 | 120k |
| R95, R98 | 39k |
| R97, R100, R101 | 15k |
| R99 | 1.8k |
| R115 | 10M |
| R203, R202 | 680 |

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A security assembly (10) for indicating when a closable entrance has been intruded, said assembly (10) comprising; entrance monitoring means (12) for producing an intrusion signal when an entrance has been intruded, console means (14) having an armed mode and disarmed mode for receiving said intrusion signal and indicating when the entrance has been intruded when said console means (14) is in said armed mode, and remote control means (18) for setting said console means (14) in said armed and disarmed modes, said remote control means (18) including arm button means (20) to be manually actuated for setting said console means (14) in said armed mode to transmit an arming coded radio signal and disarm button means (22) to be manually actuated for setting said console means (14) in said disarmed mode to transmit a disarming coded radio signal.

2. An assembly as set forth in claim 1 further characterized by said remote control means (12) including remote control encoder means (74) responsive to said arm button means (20) and said disarm button means (22) for transmitting said coded radio signals.

3. An assembly as set forth in claim 2 further characterized by said console means (14) including remotely controlled panic means by receiving an extended coded radio signal from said remote control means (18) to produce said intrusion signal.

4. An assembly as set forth in claim 3 further characterized by said remote control means (12) including transmitting indication means for visually indicating when a coded signal is being transmitted.

5. An assembly as set forth in claim 1 further including alarm means (16) responsive to said console means (14) for audibly indicating when an entrance has been intruded.

6. An assembly as set forth in claim 5 further characterized by said console means (14) including remotely controlled panic means (98) for receiving an extended coded radio signal from said remote control means (18) to activate said alarm means (14).

7. An assembly as set forth in claim 6 further characterized by said console means (14) including arming switch means (24) for setting said assembly (10) in the armed mode, test switch means (26) for setting said console means (14) in a test mode to test said entrance monitoring means (12) for proper operation, panic switch means (28) for immediately turning on said alarm means (16), disarming switch means (30) for setting said assembly (10) in said disarmed mode and for turning off said audible signal and for exiting said test mode.

8. An assembly as set forth in claim 7 further characterized by said console means (14) including timer means (40) for turning said alarm means (16) on for a predetermined time.

9. An assembly as set forth in claim 8 further characterized by said console means (14) including console receiver means (80) for receiving said coded radio signals from said remote control means (18) and said entrance monitoring means (12) to produce a detected signal, and amplifier limiter means (82, 84) for amplifying and magnitude limiting said detected signal producing a coded signal, and entrance monitor decoder means (86) for receiving and decoding said coded signal producing an intrusion signal when said entrance monitoring means (12) has produced an intrusion coded signal indicating that the entrance has been intruded, and controller decoder means (88 for receiving and decoding said arming coded radio signal and said disarming coded radio signal to produce a mode signal representative of the armed or disarmed mode of said console means (14).

10. An assembly as set forth in claim 9 further characterized by said console means (14) including alarm encoder means (90) for encoding and producing a coded alarm signal in response to said timer means (40) and said armed indicating means and said intrusion indicating means (36), and alarm transmitter means (92) for receiving said coded alarm signal and turning on said alarm means (16).

11. An assembly as set forth in claim 10 further characterized by said console means (14) including arm flip-flop means (94) for receiving said mode signal and said arming switch and said disarming switch for setting said console means (14) in said armed mode and said disarmed mode producing an arm signal representative of said mode.

12. An assembly as set forth in claim 11 further characterized by said console means (14) including alarm flip-flop means (96) for receiving said intrusion signal and said arm signal to initiate said timer means (40).

13. An assembly as set forth in claim 12 further characterized by said console means (14) including power indication means (100) for visually indicating when power is being supplied to said console means (14) by a continuous indication, and including battery back-up (102) such that said power indication means (100) visually indicates by a chopped indication when said battery backups (102) are being used.

14. An assembly as set forth in claim 2 further characterized by said arming coded signal including an inverted bit from said disarming coded signal to distinguish from said coded signals.

15. A security assembly (10) for indicating when a closable entrance has been intruded, said assembly (10) comprising: entrance monitoring means (12) for transmitting a radio frequency intrusion coded signal when the entrance has been intruded; console means (14) having armed and disarmed modes for receiving said intrusion coded signal and transmitting an alarm radio signal indicating intrusion when said console means is in said armed mode, said console means including disarming switch means (30) for disarming said console means and discontinuing said alarm radio signal when said console means is in said armed mode, and timer means (40) for limiting the transmission of said alarm radio signal to a predetermined time in absence of the actuation of said disarm button means; remote control means (14) for alternatively setting said console means (14) in said disarmed mode and for discontinuing transmission of said alarm radio signal; and alarm means (16) remote from said console means (14) for receiving said alarm radio signal and producing an audible signal continuing until said alarm radio signal is discontinued by said console means.

16. An assembly as set forth in claim 15 further characterized by said console means (14) including console receiver means (80) for receiving said coded radio signals from said remote control means (18) and said entrance monitoring means (12) to produce a detecting signal, and amplifier limiter means (82, 84) for amplifying and magnitude limiting said detected signal producing a coded signal, and entrance monitor decoder means (86) for receiving and decoding said coded signal producing an intrusion signal when said entrance monitoring means (12) has produced an intrusion coded signal indicating that the entrance has been intruded, and controller decoder means (88) for receiving and decoding said arming coded radio signal and said disarming coded radio signal to produce a mode signal representative of the armed or disarmed mode of said console means (14).

17. An assembly as set forth in claim 16 further characterized by said console means (14) including arm flip-flop means (94) for receiving said mode signal and said arming switch means (24) and said disarming switch means (30) for setting said console means (14) in said armed mode and said disarmed mode producing an arm signal representative of said mode.

18. An assembly as set forth in claim 17 further characterized by said console means (14) including alarm flip-flop means (96) for receiving said intrusion signal and said arm signal to initiate said timer means (40).

19. An assembly as set forth in claim 15 further characterized by said alarm means (16) including alarm receiver means for receiving and detecting said alarm radio signal from said console means (14) producing an alarm signal for indication of the intrusion of an entrance, said alarm means (16) including alarm amplifier means (54) for amplifying said alarm signal producing an amplified alarm signal, and alarm limiter means (56) for receiving said amplified alarm signal and limits the magnitude of said amplified alarm signal producing an alarm limited signal.

20. An assembly as set forth in claim 19 further characterized by said alarm means (16) including alarm decoder means (58) for receiving said alarm limited signal and producing a pulsed signal in response thereto.

21. An assembly as set forth in claim 20 further characterized by said alarm means (16) including storage means (60) receiving said pulsed signal for increasing its magnitude above a predetermined limit, and trigger means (62) for producing a control signal when said storage means is above said predetermined limit.

22. An assembly as set forth in claim 21 further characterized by said alarm means (16) including first (64) and second (66) frequency oscillator circuits for producing a dual tone frequency signal, and audible means (68) for converting said dual tone frequency signal into an audible signal.

23. An assembly as set forth in claim 22 further characterized by said console means (14) and said remote alarm means (16) including power backup means (70, 102).

24. A security assembly for indicating when a closable entrance has been intruded when in an armed mode and not indicating when an entrance has been intruded when in a disarmed mode, said assembly (10) comprising; remote control means (18) for setting the security assembly (10) by radio signals in the respective armed and disarmed modes, said remote control means (18) including arm button means (20) for depressing to arm the security assembly (10) and disarm button means (22) for depressing to disarm the security assembly (10), said arm button means (20) and said disarm button means (22) being in close proximity, said remote control means (18) including protective cover means for sliding across one of said buttons exposing the other for depression and sliding partially over both of said buttons to prevent accidental depression of said buttons.

25. A security assembly for indicating when a closable entrance has been intruded, said assembly (10) comprising; entrance monitoring means (12) for producing an intrusion coded signal of a first combination code when the entrance has been intruded, remote control means (18) for arming and disarming said assembly (10) by transmitting a coded radio signal of a second combination code for arming and a third combination code for disarming, and console means (14) for receiving said coded radio signal to compare said second and third combinations to a second preselected code for arming or disarming said assembly (10) and for receiving said intrusion coded signal to compare said first combination to a first preselected code for indicating intrusion when armed.

26. An assembly as set forth in claim 25 further characterized by including alarm means (16) remote from said console means (14) for receiving said alarm radio signal of said second combination code and comparing it to a predetermined code for producing an indication signal.

27. A security assembly (10) for indicating when a closable entrance has been intruded, said assembly (10) comprising ; entrance monitoring means (12) for producing an intrusion coded signal when the entrance has been intruded, console means (14) having armed and disarmed modes for receiving said intrusion coded signal and indicating when the entrance has been intruded when in said armed mode, remote control means (18) for setting said console means (14) in said armed mode and disarmed mode, and said console means (14) including armed indicating means (32) for audibly indicating when said console means (14) has been set in said armed mode and preventing audible indication when said console means (14) has been set in said disarmed mode.

28. A security assembly for indicating when a closable entrance has been intruded, said assembly comprising: entrance monitoring means (12) for transmitting a radio frequency intrusion coded signal when the entrance has been intruded; console means (14) having armed and disarmed modes for receiving said intrusion coded signal and transmitting an alarm radio signal indicating intrusion when said console means is in said armed mode, said console means (14) including timer means (40) for limiting the transmission of said alarm radio signal to a predetermined time in absence of being set in said disarmed mode; remote control means (14) for setting said console means (14) in said disarmed mode and for discontinuing transmission of said alarm radio signal; and alarm means (16) remote from said console means (14) for receiving said alarm radio signal and producing an audible signal continuing until said alarm radio signal is discontinued.

* * * * *